US011377238B2

(12) United States Patent
Siewecke et al.

(10) Patent No.: US 11,377,238 B2
(45) Date of Patent: Jul. 5, 2022

(54) PACKAGING MACHINE AND METHOD FOR INTRODUCING BULK MATERIALS INTO CONTAINERS

(71) Applicant: HAVER & BOECKER OHG, Oelde (DE)

(72) Inventors: Klaus Siewecke, Rheda-Wiedenbrück (DE); Willi Vollenkemper, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 9 days.

(21) Appl. No.: 16/956,298

(22) PCT Filed: Dec. 17, 2018

(86) PCT No.: PCT/EP2018/085299
§ 371 (c)(1),
(2) Date: Jun. 19, 2020

(87) PCT Pub. No.: WO2019/121561
PCT Pub. Date: Jun. 27, 2019

(65) Prior Publication Data

US 2020/0324928 A1 Oct. 15, 2020

(30) Foreign Application Priority Data

Dec. 21, 2017 (DE) ..... 102017130958.6

(51) Int. Cl.
*B65B 1/18* (2006.01)
*B65B 1/10* (2006.01)
(Continued)

(52) U.S. Cl.
CPC ..... *B65B 1/18* (2013.01); *B65B 1/06* (2013.01); *B65B 1/10* (2013.01); *B65B 1/28* (2013.01);
(Continued)

(58) Field of Classification Search
CPC .... B65B 1/18; B65B 1/06; B65B 1/10; B65B 1/28; B65B 1/30; B65B 1/20; B65B 1/04; B65B 39/001; B65B 39/002
See application file for complete search history.

(56) References Cited

U.S. PATENT DOCUMENTS 2,260,718 A * 10/1941 Merrifield ..... B65B 67/12 177/56
3,189,061 A * 6/1965 Stockel ..... B65G 53/00 141/68
(Continued)

FOREIGN PATENT DOCUMENTS

DE 102013009284 12/2014
DE 102014100346 7/2015
(Continued)

OTHER PUBLICATIONS

German Search report from the corresponding German Patent Application No. 102017130958.6, dated Oct. 1, 2018.
(Continued)

*Primary Examiner* — Nicolas A Arnett
(74) *Attorney, Agent, or Firm* — Greer, Burns & Crain, Ltd

(57) ABSTRACT

A packaging machine and method for filling bulk materials into packages with a rotatable machine frame and a plurality of circumferentially arranged filling spouts. During frame rotation, bulk materials are filled into packages. A machine silo is configured at the machine frame which has a storage volume for storing a quantity of bulk materials for filling a plurality of packages. Bulk materials are filled into the attributed packages from the silo through the filling spout. The machine silo is connected with a material supply with a controllable closing member for feeding bulk materials to the machine silo. A controller controls the closing member of the material supply dependent on the fill level to reduce
(Continued)

the height of fall of the bulk materials being fed into the silo, or to avoid a free fall of the bulk materials during the feeding of bulk materials into the machine silo.

20 Claims, 4 Drawing Sheets

(51) Int. Cl.

| | |
|---|---|
| ***B65B 1/28*** | (2006.01) |
| ***B65B 1/30*** | (2006.01) |
| ***B65B 39/00*** | (2006.01) |
| ***B65B 1/06*** | (2006.01) |
| *B65B 1/20* | (2006.01) |

(52) U.S. Cl.
CPC ..... *B65B 1/30* (2013.01); *B65B 39/002* (2013.01); *B65B 1/20* (2013.01)

(56) References Cited

U.S. PATENT DOCUMENTS

| | | | | |
|---|---|---|---|---|
| 3,304,964 | A * | 2/1967 | Rose | B65B 1/16 141/68 |
| 3,502,119 | A * | 3/1970 | Sweeney | B65B 1/18 141/68 |
| 4,751,948 | A | 6/1988 | Hertig et al. | |
| 5,727,607 | A * | 3/1998 | Ichikawa | B65B 1/16 141/374 |
| 5,753,867 | A * | 5/1998 | Konishi | G01G 19/393 177/25.18 |
| 7,866,353 | B2 * | 1/2011 | Combrink | B65B 1/32 141/12 |
| 9,540,123 | B2 * | 1/2017 | Vollenkemper | B65B 57/145 |
| 9,650,161 | B2 * | 5/2017 | Wehling | B65B 1/36 |
| 9,802,724 | B2 * | 10/2017 | Vollenkemper | B65B 1/04 |
| 10,173,794 | B2 * | 1/2019 | Breulmann | B65B 1/28 |
| 10,625,890 | B2 * | 4/2020 | Vollenkemper | B65B 1/28 |
| 2013/0048148 | A1 * | 2/2013 | Matye | B65B 1/06 141/99 |
| 2014/0305542 | A1 | 10/2014 | Vollenkemper | |
| 2016/0122042 | A1 | 5/2016 | Breulmann | |

FOREIGN PATENT DOCUMENTS

| | | |
|---|---|---|
| EP | 0032481 | 7/1981 |
| GB | 1513278 | 6/1978 |

OTHER PUBLICATIONS

International Search report from the corresponding International Patent Application No. PCT/EP2018/085299, dated Mar. 14, 2019.

* cited by examiner

PACKAGING MACHINE AND METHOD FOR INTRODUCING BULK MATERIALS INTO CONTAINERS

BACKGROUND

The present invention relates to a packaging machine and a method for filling bulk materials into packages, wherein the packaging machine comprises a rotatable machine frame and a plurality of filling spouts distributed over the circumference of the packaging machine, so as to fill bulk materials into packages while the packaging machine respectively the machine frame is rotating. The machine frame is provided with a machine silo with a storage volume for storing a quantity of bulk materials for filling a plurality of packages. The bulk materials are conveyed from the machine silo to each of the filling spouts and filled into the associated or attributed or appended packages.

The invention relates in particular to a packaging machine and a method for bagging fine-grained and dusty bulk materials, such as cement, mortar products, calcium hydroxide, etc.

In the prior art, a great variety of packaging machines and methods have been disposed for bagging fine-grained and dusty bulk materials such as cement into packages. When filling bulk materials into packages such as open-mouth bags or valve bags, a (small) quantity of air is introduced as a rule so as to maintain flowability of the bulk materials and ensure an effective and efficient bagging operation. When the bulk materials intended for filling contain too little air during filling, then the flowability decreases, the bulk materials may be prone to bridging, and the bagging conditions deteriorate. When the bulk materials contain too much air during filling, there is the drawback that after the process the filled packages are larger than they need to be. The de-aeration time also increases, slowing down the filling process. Moreover, they show a low surface firmness. Packages filled with bulk materials appear more attractive and more stable with a lower air proportion. Moreover, a lower air proportion involves decreased material requirements for the packages respectively bags, so as to decrease the costs for the packages. At the same time the stowage volume decreases so that the transport costs decrease as well.

This is why packages filled with bulk materials are being de-aerated even during filling or right thereafter to remove at least part of the entrapped air.

It has been found that the conditions while filling bulk materials into packages change during the operation. Thus, seasonal fluctuations may occur. Furthermore, the flow behavior of the bulk materials may also be related to the ambient temperature and the ambient humidity. It has also been found that following a standstill of the packaging machine—when the product has settled—the filling conditions differ from those in an ongoing operation.

It is therefore the object of the present invention to provide a packaging machine and a method for filling bulk materials into packages which allow an efficient filling of bulk materials into packages and which achieve more uniform filling results.

SUMMARY

A packaging machine according to the invention for filling bulk materials into packages is configured rotatable respectively comprises a rotatable machine frame. Over the circumference of the packaging machine or the machine frame, a plurality of filling spouts is disposed so as to fill bulk materials into packages while the machine frame is rotating. It is conceivable for the packaging machine to be configured for filling valve bags. It is also possible that the packaging machine is configured for filling bulk materials into open-mouth bags or other packages. The machine frame is provided with a machine silo with a storage volume for storing a quantity of bulk materials for filling a plurality of packages. Bulk materials can be filled into the associated or attributed and in particular appended packages from the machine silo through the filling spout or spouts. The machine silo is in turn connected with (at least) one material supply with a controllable closing head or closing member for feeding bulk materials to the machine silo. In this case, this means that the machine silo serves as an intermediate silo in which a storage volume for filling a plurality of packages is configured. Therefore, the bulk materials do not need to be supplied separately for each package from an external silo. A control device is provided with which to control the closing member of the material supply dependent on the fill level, so as to reduce the height of fall of the bulk materials while the bulk materials are being fed into the machine silo, or so as to avoid, in particular largely and preferably to the greatest extent possible in continuous operation, free fall of the bulk materials into the machine silo while feeding the bulk materials.

The packaging machine according to the invention has many advantages. A considerable advantage of the packaging machine according to the invention consists in the fact that in continuous operation of the packaging machine, the bulk materials are largely or entirely prevented from falling freely into the machine silo, or that the height of free fall is reduced as far as possible. Also preferred is sub-level filling wherein free fall of the bulk materials is virtually nonexistent in regular operation. The invention causes substantially the same characteristics of the bulk materials filled into the machine silo in any and all the continuous operating scenarios. The fact that the height of fall is minor and free fall is in particular avoided as far as possible, considerably reduces any air entering into the bulk materials while filling the machine silo.

Therefore, the bulk materials in the machine silo show considerably more homogeneous conditions than in the prior art where bulk materials were filled into the machine silo at intervals from a height of fall of for example 1 m or 2 m (min-max control). Thereafter the bulk materials were filled directly into the packages or the system was stopped for example due to maintenance, so that the bulk materials stored in the machine silo could be de-aerated prior to starting filling. These different conditions in turn also result in different conditions of the filled packages. The invention considerably reduces these kinds of differences. A continuous filling process is ensured and the weight accuracy is in particular also improved. Thus, the reject rate of underweight packages is also reduced.

In the case of a conventional rotary packaging machine, the subsequent supply of bulk materials into the machine silo is done by feeding bulk materials to the silo at periodic intervals in free fall through the non-rotary cover. As a rule, this will cause considerable dust formation in subsequent supplies. The bulk materials thus take up much air which changes their flow characteristics. Moreover, sealing measures notwithstanding, the sealing gap between the rotating silo and the stationary cover, and cracks and openings, let escape a comparatively large quantity of dust. This requires a larger air volume for dust removal, which in turn increases the system costs and the overhead. By means of the invention, no (or a very small quantity of) air is introduced into the product while replenishing the silo, since the bulk materials are largely prevented from freely falling. This causes much more homogeneous conditions over time than in the prior art, already in the (rotary) machine silo. Changes to the product characteristics over time due to the periodic air intake in replenishing are avoided, and changes to the product characteristics during standstill are also reduced since the product contains less air which may escape over time.

Another considerable advantage is that energy consumption for dedusting is reduced. Packing silos filled in free fall according to the prior art tend to generate dust, and vacuuming involving a large volume flow is required to reduce dust pollution. Also, this causes considerable loss of material.

In all the configurations it is preferred for the machine silo to be connected with the filling spout for example through product travel paths or conveying ducts. Preferably one conveyor element is provided for each filling spout for (controlled) conveying of the bulk materials into the attributed or appended package.

In preferred specific embodiments the control device is configured as a passive control device. The control device can in particular be configured mechanical.

Preferred specific embodiments provide for the closing member to be coupled with a pivoting lever and/or a paddle. The pivoting lever may be in particular mechanically coupled directly with the closing member. Alternately, it is possible for the pivoting lever to be coupled with the closing member through a deflector or a motor coupling. Also conceivable is a hydraulic or pneumatic coupling where the closing member is pivoted along, for example through a swivel cylinder, as the pivoting lever is pivoted.

The closing member preferably comprises at least one valve gate mechanism. A valve gate mechanism may e.g. be configured as a flap gate mechanism. It is also possible e.g. for the valve gate mechanism to comprise a shut-off gate or a flap shutter or the like. A shut-off gate or the like may enter the closing member e.g. from the side, thus reducing the clear flow cross-section continuously or in steps.

The (mechanical) pivoting lever is preferably provided for detecting the fill level of the bulk materials by way of contacting the bulk materials in the machine silo. In these configurations, the pivoting lever may serve as a simple passive control device. The height of the fill level is directly detected by way of the pivot position of the pivoting lever. This configuration allows a configuration of a packaging machine according to the invention which is permanently functional and offers ease of maintenance.

In the scope of the present invention, the term "pivoting lever" may be consistently replaced by the terms "pivoting member" or "pivoting unit".

The pivoting lever preferably rests (at least partially) on the bulk materials in the machine silo (as far as the fill level reaches). It is possible and preferred for the pivoting lever to be at least partially immersed in the bulk materials in the machine silo. The pivoting lever glides in particular partially on the material level of the bulk materials. The pivoting lever may glide on the bulk materials as in "waterskiing". The product stream, which moves in a circle relative to the pivoting lever during rotation of the machine frame, suitably deflects the pivoting lever so that the position of the pivoting lever is a measure of the fill level of the bulk materials. The pivoting lever may form part of a sensor device. The sensor device serves to capture the fill level of the bulk materials in the machine silo.

In preferred configurations the pivot axis of the pivoting lever is oriented transverse and in particular off-center to the pivot axis of the machine frame. The pivot axis of the pivoting lever may for example be oriented approximately horizontally, while the rotation axis of the machine frame is preferably oriented vertically. In preferred configurations, the pivot axis of the pivoting lever is in particular oriented approximately radially but it may be vertically inclined. In preferred configurations the pivot axis is approximately in a plane including, or parallel to, the rotation axis. The angle at which the pivot axis intersects the plane with the rotation axis of the machine frame is preferably <30° and preferably less than 15°. These kinds of parameters achieve an advantageous configuration wherein during rotation of the machine frame a pivoting lever may rest on, or be immersed in, the bulk materials, thus permitting useful detection of the fill level.

Also conceivable is a vertical or inclined pivot axis of the pivoting lever e.g. by way of utilizing the stagnation pressure and a return spring. One may for example, utilize the stagnation pressure on a paddle which is preloaded by a restoring device and which is deflected counter to the force of the restoring device as the fill level increases, thus capturing a measure of the fill level. A closing member controlling the supply to the machine silo may be directly (mechanically) coupled therewith.

In preferred specific embodiments, the pivoting lever is preloaded in particular downwardly by means of a spring device. In this way the pivoting lever is reliably pressed onto the surface of the bulk materials storage in the machine silo. Preferably, the spring device comprises at least one gas spring. A gas spring offers the advantage that as the spring force is exceeded, rebound is readily possible. In preferred configurations a piston cylinder unit is used as a spring device, or the spring device comprises at least one such piston cylinder unit. Piston cylinder units also enable hydraulic or pneumatic coupling of the pivoting lever with the closing member. In all the configurations, it is preferred for the material supply to comprise a filling pipe. Bulk materials are fed to the machine silo through the filling pipe. The filling pipe preferably comprises a stationary pipe section and a pivotable pipe section. The bulk materials for replenishment emerge from the pivotable pipe section.

The pivotable pipe section may preferably (also) directly serve as a pivoting lever. Then, at least one shaped part and e.g. one (or two or more) blade(s) may be configured thereat, or attached thereto, to ensure that the pivotable pipe section deflects as a function of the fill level. Then, no separate pivoting lever is required.

In other configurations a separate pivoting lever is provided, and the pivotable pipe section is pivotable together with the pivoting lever. Joint pivoting of the pivotable pipe section and of the pivoting lever may be realized by way of directly mechanically coupling the pivotable pipe section with the pivoting lever. For example, a chain drive or belt drive may be provided between the two pivotable members. Alternately, a hydraulic or pneumatic coupling is conceivable so that as the pivoting lever pivots, the pivotable pipe section co-pivots along. A spring device may also enable for example the pivoting lever to pivot further than does the pivotable pipe.

It is preferred for the closing member to be configured on the pivotable pipe section. The closing member may be configured for example as a flap shutter. It is also possible for the closing member to show a suitably configured circle segment structure which slides across the opening of the stationary pipe section as the pivotable pipe section is pivoting, thus decreasing and increasing the clear opening cross-section of the filling pipe. Preferably, the material supply is completely opened when the fill level is less than 30% or 40% or 50% or 60% or 70% of the maximum fill height. In particular is the pivoting lever disposed such that the closing member completely opens the (feed opening of the) material supply at least in the case that the pivoting lever is no longer immersed in the bulk materials or in the quantity of bulk materials respectively is no longer in contact with the product level. It is possible to open the feed opening completely when the fill level is less than 50% (or another suitable value) of the maximum fill height.

Preferably, the material supply is at least partially closed when the fill level is above 70% or above 80% or above 90% or 95% of the maximum fill height. In particular is the pivoting lever disposed so that the material supply is at least partially or suitably closed when the fill level reaches a suitable portion of the maximum fill height.

In advantageous specific embodiments, the closing member closes the feed opening of the material supply when the fill level reaches a specified height.

In all the configurations, it is preferred for the clear cross section of the feed opening of the material supply to be inversely proportional to the fill level. Alternately, a digital configuration is conceivable wherein the clear cross section of the feed opening is either entirely open or entirely closed. It is also possible for the clear cross-section of the feed opening of the material supply to be inversely proportional across a specific height range. It is for example possible for the feed opening to be entirely opened across a specific height range and to begin closing only as for example 50% (or 70% etc.) of the maximum fill height is reached.

In all the configurations, it is preferred that at least one contactless detector for sensing the fill level is comprised. The contactless detector may be a component of the sensor device. Such a contactless detector may be configured as a capacitive, inductive, optical and/or ultrasonic sensor and/or radar sensor or the like. Also possible is the use of multiple detectors which perform fill level measurements independently of one another, simultaneously or time-shifted. Such a contactless detector, or an additional, contacting detector may be used to permit active controlling. These detectors are also conceivable for monitoring the operation.

In the case of active controlling, an actuator is preferably provided for (supporting) the movement of the closing member. Purely active controlling is also possible.

In all the configurations, it is possible for the control device to (actively) control the position of the closing member as a function of the sensor signal of the sensor device.

A method according to the invention relates to filling bulk materials into packages by means of a packaging machine having a rotary machine frame and a plurality of filling spouts distributed over the circumference so as to fill bulk materials into packages while the machine frame is rotating. The machine frame is provided with a (co-rotating) machine silo with a storage volume for storing a quantity of bulk materials sufficient for filling a plurality of packages. The machine silo fills bulk materials into the packages (through product travel paths or conveying ducts) through a (selected) filling spout. At least one material supply with a controlled closing member is attributed to the machine silo so as to feed bulk materials to the machine silo. The subsequent supply of the bulk materials into the machine silo may be provided continuously. As a function of the fill level in the machine silo, a control device controls the closing member of the material supply to prevent the bulk materials from freely falling into the machine silo while bulk materials are being fed in continuous operation, or to reduce the height of the free fall as far as possible. In preferred specific embodiments and configurations, sub-level filling is permitted.

The method according to the invention also has many advantages. The method according to the invention allows considerable reduction of the air volume which is introduced while filling the machine silo with the bulk materials. This allows to provide considerably more consistent conditions in filling bulk materials into packages.

Another advantage is that the filling of the machine silo generates less dust requiring complex dedusting. This permits to reduce dust removal capacities so as to cut down on energy and costs. Also, the sealing between the rotary machine silo and the stationary cover can be simpler in configuration.

Depending on the configuration, it is possible that considerable free falling distances show when first filling the storage volume in the first start-up or following a change of products. Since these processes are comparatively rare and they are certainly known at the time, this may be taken into account in the directly following filling process so as to achieve consistent conditions in the filled packages again.

BRIEF DESCRIPTION OF THE DRAWINGS

Further advantages and features of the present invention can be taken from the exemplary embodiment which will be described below with reference to the enclosed figures.

The figures show in.

DETAILED DESCRIPTION

Figure 1:
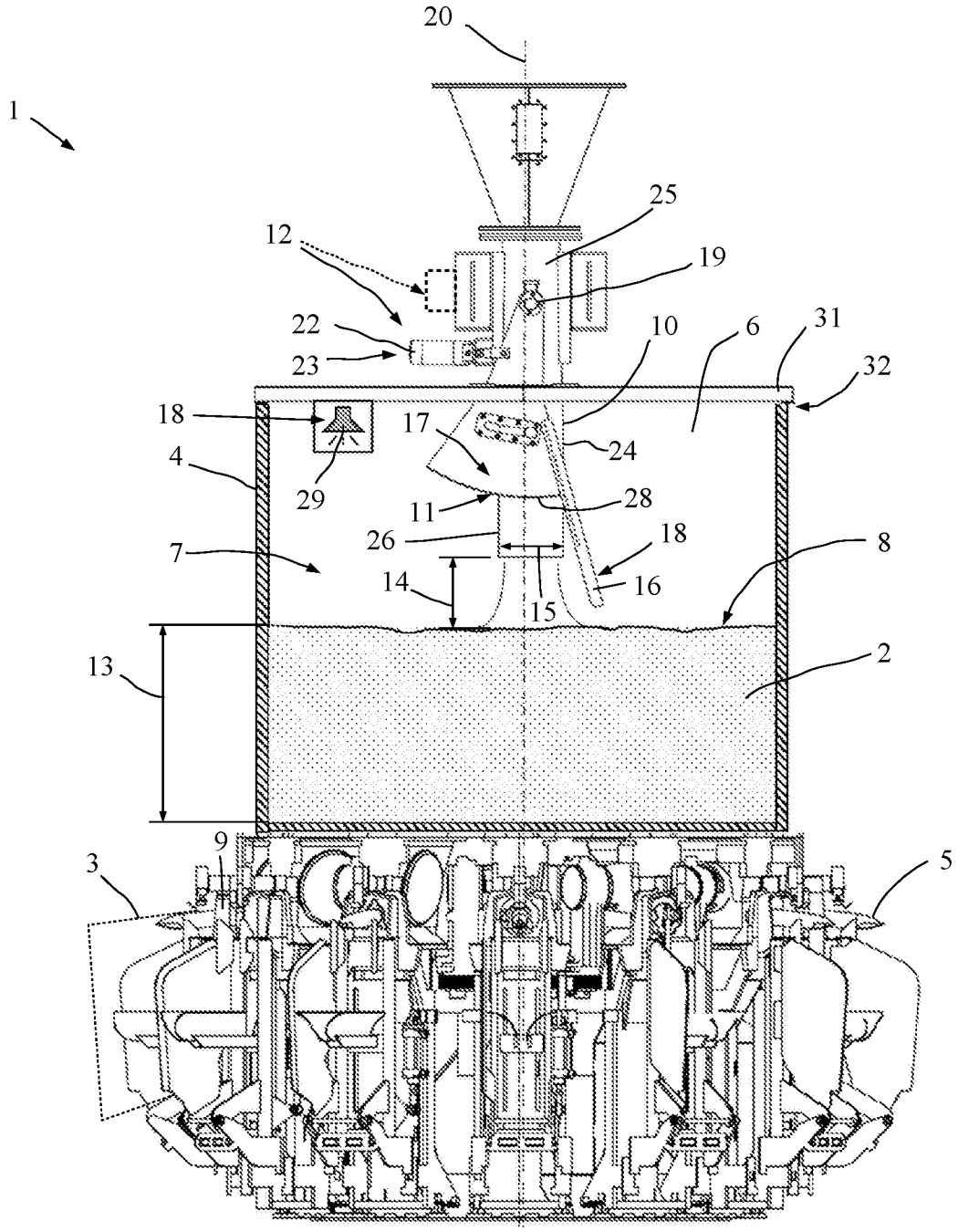
FIG. 1 a schematic sectional view of a packaging machine according to the invention during first filling with an intended fill of bulk materials.

FIG. 1 illustrates a packaging machine 1 for filling bulk materials 2 into packages 3. The packaging machine 1 is rotary in configuration and is provided with a plurality of filling spouts 5 distributed over the circumference for filling bulk materials 2 into packages 3 during rotation.

This FIG. 1 schematically shows a valve bag as the package 3. It is likewise possible that the packaging machine serves for filling bulk materials into open-mouth bags or other types of packages. As a rule, the packages are appended for filling with the bulk materials to the filling spout, where they are received tightly to prevent dust from escaping during the filling process.

While the bulk materials 2 are being filled into the package 3, a small quantity of air is as a rule introduced into the bulk materials 2 in the product travel path, so as to maintain the bulk materials 2 flowable and to provide homogeneous and reproducible conditions during the filling process. The bulk materials 2 are as a rule transported into the packages 3 through a conveyor element 9. Such a conveyor element may for example be configured as a conveyor turbine. Alternately, augers may be used or conveying by way of gravity, or other conveyor elements may be used.

A machine silo 6 is configured on the (rotatable) machine frame 4 above the filling spout 5 and the conveyor elements 9. The machine silo 6 provides a storage volume 7 for receiving a quantity of bulk materials 8. The storage volume 7 is larger than the volume of the largest possible package intended for filling by way of the packaging machine 1. In particular is the storage volume multiple times larger than the volume of one filled package 3.

The quantity of bulk materials 8 serves as a temporary storage for bulk materials so as to provide continuous and homogeneous conditions inside the packaging machine 1. In this way, the filling conditions can be maintained even and consistent.

Identical filling conditions are achieved in a considerably improved way in that the material supply 10 is controlled such that following the first filling shown in FIG. 1, subsequent heights of fall are small (or virtually or actually non-existent) or sub-level filling is provided in ongoing operation.

The material supply 10 comprises a closing member 11 which is configured like a flap gate mechanism 17. The material supply 10 consists of a filling pipe 24 comprising a stationary pipe section 25 and a pivotable pipe section 26. The pivotable pipe section 26 is pivotable around the pivot axis 19. In relation to the rotational angle, the clear cross-sections of the stationary pipe section 25 and of the pivotable pipe section 26 are more or less flush to one another, thus clearing only part of the feasible cross section of the feed opening 28.

Thus the product flowing out of the storage silo backs up in the stationary pipe section, resulting in settling and deaeration. When "depositing" the bulk materials on the filled level respectively when introducing it beneath the filled level, an aeration of the bulk materials (product) and dust formation in the machine silo are drastically reduced. Moreover, the bulk materials are ensured to show considerably increased homogeneity in the machine silo and during filling.

The cross section of the stationary pipe section 25 and of the pivotable pipe section 26 may be round, triangular, square, polygonal, oval and/or rounded. The cross-sections may be adapted to the product. Intentional selection of the cross-sections of the pipe sections or interposing a valve gate or valve allow to take specific product characteristics into account.

FIG. 1 illustrates the state during the first filling, wherein the fill level 13 is lower by far than is the maximum fill height 27.

The pivoting lever 16 is part of a sensor device 18 respectively preferably forms the sensor device 18, which is part of the control device 12. The control device 12 controls the position of the closing member 11 of the material supply 10. Another part of the control device is the gas spring 22 of the piston cylinder unit 23, with which the pivotable pipe section 26 and the pivoting lever 16 are preloaded to the illustrated lower position. When the fill level in the machine silo 6 continues rising, the product level of the bulk materials 2 reaches the lower edge of the pivoting lever 16, which is then raised by the bulk materials 2 during rotation of the machine frame 4 by way of pivoting around the pivot axis 19. In this way, the clear cross-section of the feed opening 28 is reduced, whereby the supply of bulk materials 2 is reduced in turn.

FIG. 1 shows in dotted lines, an alternative (or additional) control device 12 provided with a drive and controlled by detectors 29 of the sensor device 18. The detectors 29 or at least one of the detectors 29 capture(s) the fill level 13 contactless and derive(s) from the measurement results the corresponding position of the closing member 11 to permit subsequent supply of the bulk materials 2 into the machine silo 6 wherein the smallest feasible amount of air is introduced. This alternative configuration does not require a pivoting lever 16 respectively it provides a redundant emergency cutout function.

Figure 2:
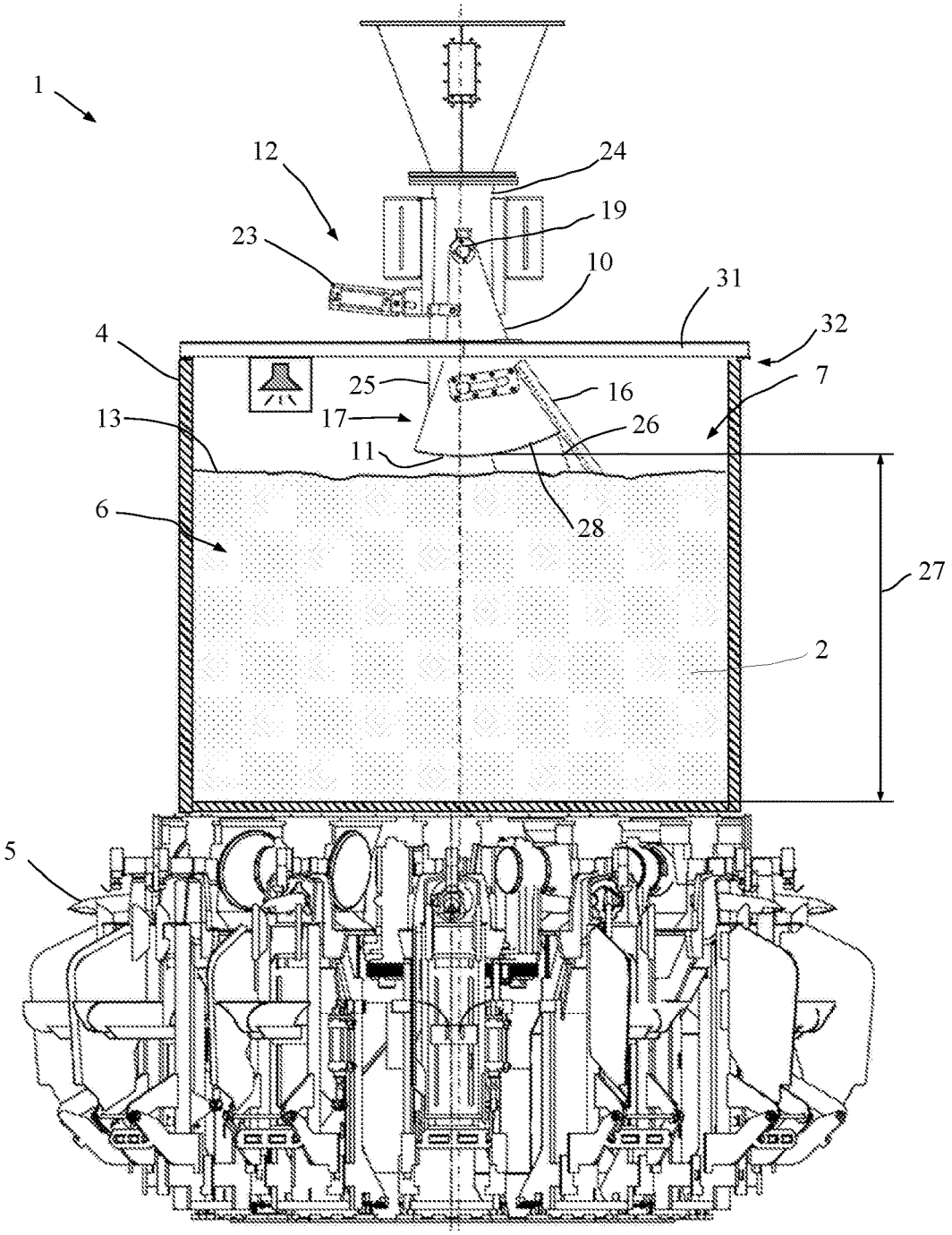
FIG. 2 the packaging machine according to FIG. 1 in a schematic sectional view in normal operation.

FIG. 2 shows the packaging machine 1 in FIG. 1 in a normal operating state after the first filling. Then a fill level 13 has been achieved which lies just slightly beneath the maximum fill height 27. In the state shown the pivoting lever 16 partially rests on the surface of, respectively is immersed in, the bulk materials 2 in the machine silo 6, and during the rotation of the packaging machine 1 respectively the machine frame 4 has been pivoted so that the pivotable pipe section 26 and the stationary pipe section 25 are no longer oriented flush, but at angles to one another.

Thus, the closing member 11 has partially closed the feed opening 28 so as to reduce the further supply of bulk materials 2.

When the fill level 13 reduces again in the further operation, then the dead weight and the force of the piston cylinder unit 23 make the pivoting lever 16 pivot downwardly so that the closing member 11 once again clears a larger portion of the feed opening 28 for the material supply, such that more bulk materials 2 can now be filled into the machine silo 6.

When no bulk materials is discharged for bagging, the fill level rises up to the maximum and, by way of the pivoting lever 16 pivoting, results in closing the feed opening 28 in the end position.

In all the configurations, the free height of fall 14 of the newly supplied bulk materials 2 is always less in normal operation than is the diameter 15 of the pivotable pipe section 26. Preferably the free height of fall is nearly zero, or sub-level filling is realized. This considerably reduces the air intake when replenishing bulk materials in the machine silo 6. Any dust is considerably reduced as well.

Figure 3:
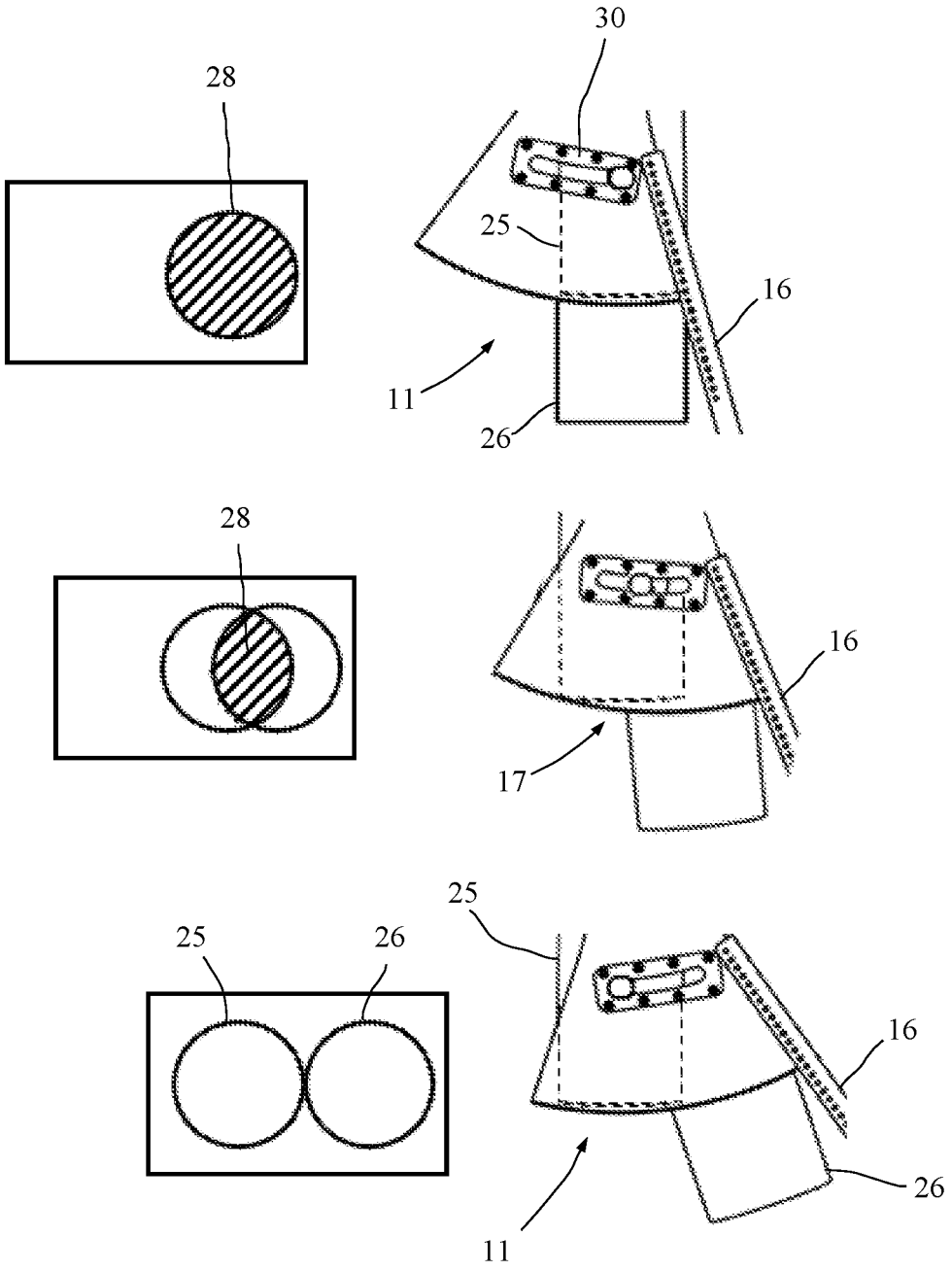
FIG. 3 various positions of the material supply in ongoing operation.

FIG. 3 simplistically shows various positions of the closing member 11 of the material supply 10 in a configuration where a stationary pipe section 25 and a pivotable pipe section 26 are pivoted against one another, resulting in different free surface portions of the feed opening 28 due to the closing member 11 performing different degrees of pivoting.

The top portion of FIG. 3 illustrates the state according to FIG. 1. The fill level 13 in the machine silo 6 is still low enough so that the pivoting lever 16 is not yet resting on the surface of the bulk materials 2. Then the stationary pipe section and the pivotable pipe section are flush to one another, clearing the maximum cross section of the feed opening 28, thus enabling replenishing a maximum amount of bulk materials 2 into the machine silo 6.

The center of FIG. 3 illustrates an intermediate state in which the fill level 13 has risen far enough for the pivoting lever 16 to rest on the surface of the quantity of bulk materials 8 in the machine silo 6. The pivoting lever 16 has been pivoted a certain distance so that now only part of the clear cross-sections of the two pipe sections 25 and 26 are flush to one another. The result is the free area of the feed opening 28 shown in hachure. This state will show in ongoing operation on a regular basis. Since the free surface of the feed opening 28 is smaller than in the top portion of FIG. 3, only a small amount of bulk materials can be filled in. However, this amount is sufficient for continuously replenishing what is filled into the packages through the filling spout on the other side, and can compensate for fluctuations of the discharge quantity.

The lower part of FIG. 3 illustrates a state where, for example, the maximum fill height 27 of the bulk materials 2 in the machine silo 6 is reached. The pivoting lever 16 is pivoted far enough so that the two pipe sections 25 and 26 are not flush to one another, so that the closing member 11 of the material supply 10 prohibits any further supply of bulk materials 2. This closed state of the closing member 11 is maintained until the fill level 13 decreases again. Then the pivoting lever 16 automatically pivots back, and the feed opening 28 partially opens once again. By shaping or suitably configuring, the curved guide 30 of the pivotable pipe section is lifted in the end position, thus achieving secure closing. To this end the pivot axis 19 is supported resiliently.

Figure 4:
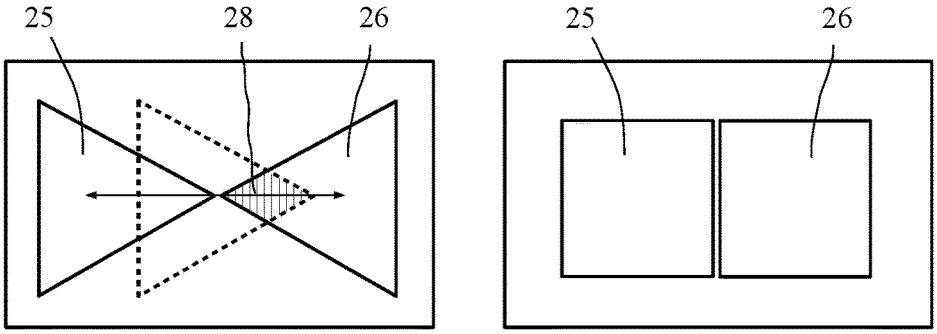
FIG. 4 various cross-sections of pipe sections of the material supply.

FIG. 4 shows further cross sectional shapes of the pipe sections 25, 26 of the material supply. Each (or only one) of the two pipe sections 25, 26 may show an e.g. triangular or square (or round) cross sectional shape. This allows adaptation of the product feed as required, to ensure optimal subsequent supply of bulk materials, as the hatched cross section of the feed opening 28 shows.

Figure 5:
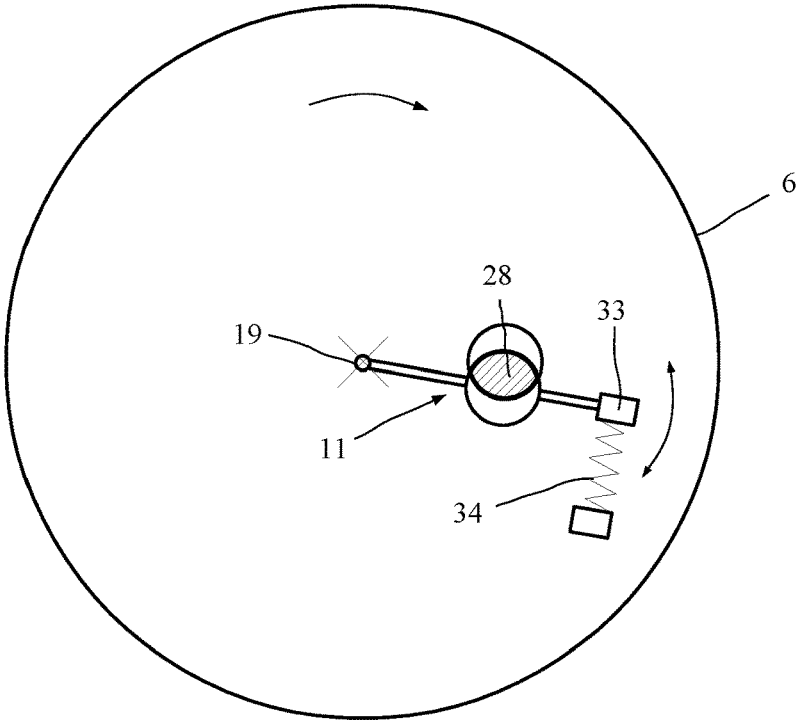
FIG. 5 a simplistic top view of a machine silo with a different material supply.
Figure 6:
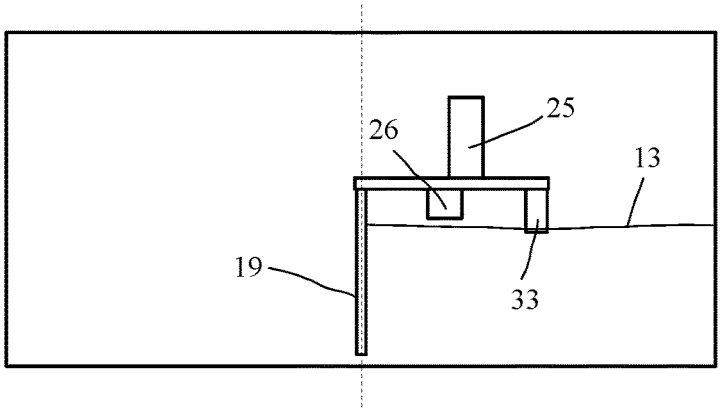
FIG. 6 a simplistic schematic cross-sectional view of the machine silo according to FIG. 5.

FIGS. 5 and 6 show a simplistic top view and a simplistic cross sectional view of a machine silo 6 with another material supply, wherein the pivot axis 19 is oriented in parallel to the rotation axis of the machine silo 6. In this case, the pivot axis 19 is identical with the rotation axis of the machine silo 6. However, this is not required. The pivot axis 19 may be disposed (slightly) off-center, and its orientation need not be vertical. In this configuration a paddle 33 immersed in the bulk materials from above is provided, which generates a stagnation pressure corresponding to the fill level height so that it is pivoted (or linearly deflected) counter to the force of the return spring 34. This allows capturing of a measure of the fill level. The cross section of the feed opening 28 is directly influenced, so as to control the subsequent supply of bulk materials into the machine silo 6. Controlling may be performed by way of the cross-sections of the closing member. It is possible for a gate to be immersed, or for a pipe section to be displaced or pivoted for varying the cross section.

While a particular embodiment of the present packaging machine and method for introducing bulk materials into containers has been described herein, it will be appreciated by those skilled in the art that changes and modifications may be made thereto without departing from the invention in its broader aspects and as set forth in the following claims.

On the whole, the invention offers many advantages since in normal operation the quantity of dust generated is considerably reduced, so as to considerably reduce the required dust removal capacities. The energy requirements are reduced as well. Moreover, the conditions during filling are more consistent and homogeneous, so that the fill results also improve. Thus, the packages can be filled in a reproducible and further enhanced quality.

| List of reference numerals: | |
|---|---|
| 1 | packaging machine |
| 2 | bulk material |
| 3 | package |
| 4 | machine frame |

-continued

| List of reference numerals: | |
|---|---|
| 5 | filling spout |
| 6 | machine silo |
| 7 | storage volume |
| 8 | bulk material quantity |
| 9 | conveyor element |
| 10 | material supply |
| 11 | closing member |
| 12 | control device |
| 13 | fill level |
| 14 | height of fall |
| 15 | diameter |
| 16 | pivoting lever |
| 17 | valve gate mechanism, flap gate mechanism |
| 18 | sensor device |
| 19 | pivot axis of 16 |
| 20 | rotation axis of 4 |
| 21 | suspension device |
| 22 | gas spring |
| 23 | piston cylinder unit |
| 24 | filling pipe |
| 25 | stationary pipe section |
| 26 | pivoting pipe section |
| 27 | maximum filling height |
| 28 | feed opening |
| 29 | detector |
| 30 | curved guide |
| 31 | cover |
| 32 | sealing |
| 33 | paddle |
| 34 | return device |

The invention claimed is:

1. A packaging machine for filling bulk materials into packages, comprising: a rotatable machine frame and a plurality of filling spouts distributed over the circumference so as to fill bulk materials into packages while the machine frame is rotating;

wherein a machine silo is configured at the machine frame and has a storage volume for storing a quantity of bulk materials for filling a plurality of packages;

wherein bulk materials can be filled into the associated packages from the machine silo through the filling spout;

wherein the machine silo is connected with a material supply having a controllable closing member for feeding bulk materials to the machine silo; and a control device is provided with which to control the closing member of the material supply dependent on the fill level, so as to reduce the height of fall of the bulk materials while the bulk materials are being fed to the machine silo, or to avoid a free fall of the bulk materials during the feeding of bulk materials into the machine silo in continuous operation; wherein a free cross section of a feed opening of the material supply is inversely proportional to the fill level.

2. The packaging machine according to claim 1, wherein the control device is configured as a passive control device.

3. The packaging machine according to claim 1, wherein the closing member is coupled with a pivoting lever.

4. The packaging machine according to claim 3, wherein the pivoting lever is provided for detecting the fill level of the bulk materials by way of contact with the bulk materials in the machine silo.

5. The packaging machine according to claim 3, wherein the pivot axis of the pivoting lever is oriented transverse to the rotation axis of the machine frame, and wherein the pivot axis of the pivoting lever is oriented in particular off-center to the rotation axis of the machine frame.

6. The packaging machine according to claim 3, wherein the pivoting lever is preloaded by means of a spring device.

7. The packaging machine according to claim 6, wherein the spring device comprises at least one gas spring.

8. The packaging machine according to claim 6, wherein the spring device comprises a piston cylinder unit.

9. The packaging machine according to claim 3, wherein the material supply comprises a filling pipe with a stationary pipe section and a pivotable pipe section, wherein the pivotable pipe section serves as a pivoting lever or is pivotable jointly with the pivoting lever.

10. The packaging machine according to claim 9, wherein the closing member is configured on the pivotable pipe section.

11. The packaging machine according to claim 3, wherein the material supply is completely open at least when the pivoting lever is no longer immersed in the bulk materials.

12. The packaging machine according to claim 1, wherein the closing member comprises a valve gate mechanism.

13. The packaging machine according to claim 1, wherein a pivoting lever rests on, or is immersed in, the bulk materials in the machine silo.

14. The packaging machine according to claim 1, wherein the closing member closes the feed opening of the material supply when the fill level reaches a specified height.

15. The packaging machine according to claim 1, wherein at least one contactless detector for sensing the fill level is provided.

16. The packaging machine according to claim 15, wherein the contactless detector is configured as a capacitive, inductive, optical, and/or ultrasonic, and/or radar sensor.

17. The packaging machine according to claim 1 wherein an actuator is provided for moving the closing member.

18. The packaging machine according to claim 1, wherein the control device controls the position of the closing member as a function of a sensor signal of a sensor device.

19. A method for filling bulk materials into packages by means of a packaging machine having a rotary machine frame and a plurality of filling spouts distributed over the circumference, so as to fill bulk materials into packages while the machine frame is rotating;

wherein a machine silo is configured at the machine frame and has a storage volume for storing a quantity of bulk materials sufficient for filling a plurality of packages;

wherein the machine silo fills bulk materials into the packages through the filling spout; wherein at least one material supply with a controlled closing member is attributed to the machine silo so as to feed bulk materials to the machine silo; and a control device controls a controller of the closing member of the material supply dependent on the fill level in the machine silo, to reduce the height of fall of the bulk materials while the bulk materials are being fed into the machine silo or to avoid a free fall of the bulk materials during the feeding of bulk materials into the machine silo in continuous operation; wherein a free cross section of a feed opening of the material supply is inversely proportional to the fill level.

20. A packaging machine for filling bulk materials into packages, comprising:

a rotatable machine frame and a plurality of filling spouts distributed over the circumference so as to fill bulk materials into packages while the machine frame is rotating;

wherein a machine silo is configured at the machine frame and has a storage volume for storing a quantity of bulk materials for filling a plurality of packages;

wherein bulk materials can be filled into the associated packages from the machine silo through the filling spout;

wherein the machine silo is connected with a material supply having a controllable closing member for feeding bulk materials to the machine silo;

said machine silo is provided with at least one sensor for determining a fill level of bulk material in the silo; and a control device is provided with which to control at least one of the closing member of the material supply dependent on the fill level, reducing the height of fall of the bulk materials while the bulk materials are being fed to the machine silo, and avoiding a free fall of the bulk materials during the feeding of bulk materials into the machine silo in continuous operation;

wherein the control device actively controls the position of the closing member as a function of a sensor signal of said at least one sensor, such that a varying amount of bulk material is supplied based on the position of the closing member.

* * * * *